US005170004A

United States Patent [19]

Garrison

[11] Patent Number: 5,170,004

[45] Date of Patent: Dec. 8, 1992

[54] HYDRAULIC SEVERANCE SHAPED EXPLOSIVE

[75] Inventor: Charles G. Garrison, San Jose, Calif.

[73] Assignee: Teledyne Industries, Inc., Northridge, Calif.

[21] Appl. No.: 740,452

[22] Filed: Aug. 5, 1991

[51] Int. Cl.[5] ..... F42B 1/02

[52] U.S. Cl. ..... 89/1.14; 102/306; 102/307; 102/701

[58] Field of Search ..... 244/122 AF; 102/306, 102/307, 309, 475, 476, 701; 89/1.14

[56] References Cited

U.S. PATENT DOCUMENTS

| | | | |
|---|---|---|---|
| 3,176,613 | 4/1965 | Godfrey et al. | 102/306 |
| 3,188,955 | 6/1965 | Brown | 102/306 |
| 3,190,219 | 6/1965 | Venghiattis | 102/306 |
| 3,335,664 | 8/1967 | Enzian | 102/307 |
| 3,374,737 | 3/1968 | Pike | 102/307 |
| 3,712,221 | 1/1973 | Voight, Jr. et al. | 89/1.14 |
| 4,170,940 | 10/1979 | Precoul | 102/476 |
| 4,407,468 | 10/1983 | Bement et al. | 89/1.14 |
| 4,594,947 | 6/1986 | Aubry et al. | 102/307 |
| 4,649,824 | 3/1987 | Guay | 102/307 |
| 4,658,726 | 4/1987 | Held | 102/306 |
| 4,905,601 | 3/1990 | Gabriel | 102/307 |
| 4,955,939 | 9/1990 | Petrousky et al. | 102/476 |
| 4,964,329 | 10/1990 | Moxon et al. | 89/1.13 |

FOREIGN PATENT DOCUMENTS

| | | | |
|---|---|---|---|
| 2492336 | 4/1982 | France | 244/122 AF |

*Primary Examiner*—David H. Brown

*Attorney, Agent, or Firm*—Blakely, Sokoloff, Taylor & Zafman

[57] ABSTRACT

An explosive device which has a retainer with a groove, that houses a charge adapted to produce a shock wave upon detonation. The retainer is attached to a target such as an airplane canopy, so that the charge is spaced from the target a predetermined distance. Between the charge and the target is a transmitting medium that transmits the shock waves of the charge to the target. The transmitting medium is constructed from an essentially incompressible material such as rubber, which transmits the shock waves without dissipating much of the blast energy of the charge.

12 Claims, 1 Drawing Sheet

HYDRAULIC SEVERANCE SHAPED EXPLOSIVE

BACKGROUND OF THE INVENTION

1. Field of the Invention

The present invention relates to explosives that can sever a target such as the canopy of an airplane or the skin of a missile.

2. Description of Related Art

Most military aircraft are constructed with an ejection seat that allows the pilot to escape the vehicle while in flight. Ejection seats typically have rockets which propel the pilot through the canopy of the plane. It has been found that the impact of the seat and pilot on the canopy, can cause serious injury to the head and spine of the pilot. To correct this problem, an explosive charge is incorporated into the cockpit to shatter or sever the canopy, before the seat and pilot reach the transparent member. Many present day aircraft typically have mild detonating cord (MDC) attached directly to the canopy, that shatters the window when detonated. The cord is usually connected to the seat through a timer that delays the ignition of the seat rockets until the cord has detonated, insuring that the canopy is ruptured before the seat reaches the top of the cockpit.

The explosive power of MDC is somewhat limited because of the large impact area of the charge, which tends to distribute the load of the explosion and reduce the force therein. It has been found that most common types of MDC do not provide a sufficient blast force to penetrate some of the thicker and stronger canopies of present day design. One solution is to increase the blast energy of the cord, but the explosion of such a device can be harmful to the pilot.

Another type of explosive typically used to shatter canopies is a linear shaped charge (LSC). A LSC has a retainer that houses a charge which is in close proximity to the canopy. Upon detonation, the charge produces a high energy jet that cuts the canopy. The charge must be spaced from the target so that the jet can develop. Unfortunately the space between the charge and the target dissipates a large amount of the energy produced by the detonated charge. Additionally, it has been found that exact dimensional requirements for the charge and spacing are necessary to obtain an effective explosive. Another associated problem with the space between the charge and the target, is the contamination and degradation of the charge from exposure to the environment. When the charge is no longer functional, it must be replaced, a time consuming procedure that creates added down time for the airplane. It would therefore be desirable to have an explosive charge which improves the severance efficiency of present charges, while being inexpensive to produce and easy to maintain.

SUMMARY OF THE INVENTION

The present invention is an explosive device which has a retainer with a groove, that houses a charge adapted to produce a shock wave upon detonation. The retainer is attached to a target such as an airplane canopy or the skin of a missile, so that the charge is spaced from the target a predetermined distance. Between the charge and the target is a transmitting medium that transmits the shock waves of the charge to the target. The transmitting medium is constructed from an essentially incompressible material such as rubber, which transmits the shock waves without dissipating much of the energy of the charge, thereby producing a more efficient explosive severance device. The rubber can be used to cover and attach the charge to the retainer, so that the charge is protected from the environment. The inclusion of the transmitting medium in the charge also reduces the need for the tight dimensional control of the charge, retainer groove and target space that existed in the art.

Therefore it is an object of this invention to provide an explosive device that creates more efficient explosive energy over charges in the prior art.

It is also an object of this invention to provide an explosive device that is environmentally protected.

It is also an object of this invention to provide an explosive device that is less expensive to produce than charges in the prior art.

BRIEF DESCRIPTION OF THE DRAWINGS

The objects and advantages of the present invention will become more readily apparent to those skilled in the art after reviewing the following detailed description and accompanying drawings, wherein.

DETAILED DESCRIPTION OF THE INVENTION

Figure 1:
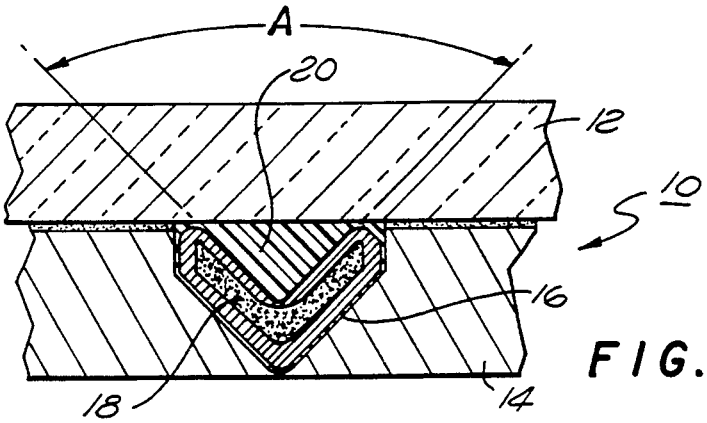
FIG. 1 is a side view of an explosive charge of the present invention attached to a target and in an undetonated state.

Referring to the drawings more particularly by references numbers, FIG. 1 shows an explosive charge 10 of the present invention. The explosive charge 10 is used primarily to penetrate a target 12, such as the canopy of an airplane. Such canopies are typically constructed from acrylic or a glass/acrylic laminate which are thick enough to prevent foreign objects (birds, etc.) from entering the cockpit of the plane. Although a canopy is discussed and shown, it is to be understood that the target can be any member or material, including but not limited to plastics, acrylics, metals and composites constructed from graphite or fiberglass, of which demolition is desired. For example, the target may be the skin of a missile that is constructed from composite material, wherein it is desirable to separate stages of the missile.

The explosive charge 10 includes an explosive retainer 14 that is attached to the target 12 by an adhesive. Although an adhesive is shown and described, it is to be understood that the retainer 14 may be attached to the target by screws, rivets or other fastener means. The retainer 14 is preferably constructed from a metal such as aluminum with a sufficient thickness to restrain the blast of an explosive charge. The retainer 14 has a groove 16 that is adjacent the target 12. In the preferred embodiment the groove 16 has a V shaped cross section that houses an explosive charge 18. It being understood that the shape of the retainer groove 16 is not critical to the invention, and that a radial or rectangular shaped groove could also be utilized. The charge 18 is constructed to create an explosive blast when detonated, that produces a high pressure shock wave. The charge 18 is preferably configured with a V shaped cross section so that the shock waves produced by the charge are directed toward a narrow target area. Although any type of explosive material can be used, it has been found that a lead charge containing Hexanitrostilbene (HNS) provides positive results. Such V shaped high explosive charges are known in the art and commercially available in the industry.

Figure 2:
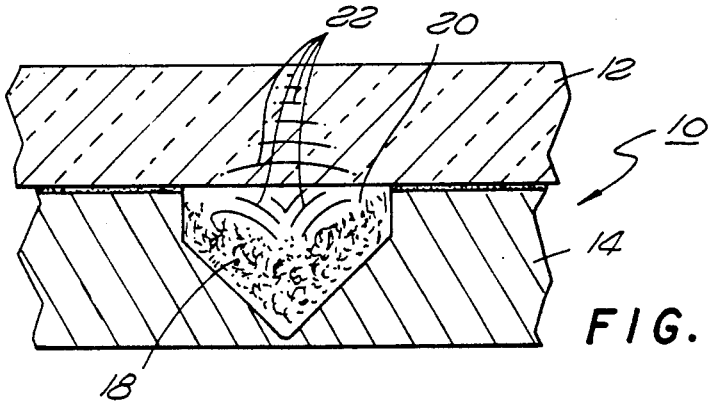
FIG. 2 is a side view of the explosive charge of FIG. 1, after the charge has been detonated, wherein the blast of the charge produces shock waves that are transmitted by a transmitting medium.
Figure 3:
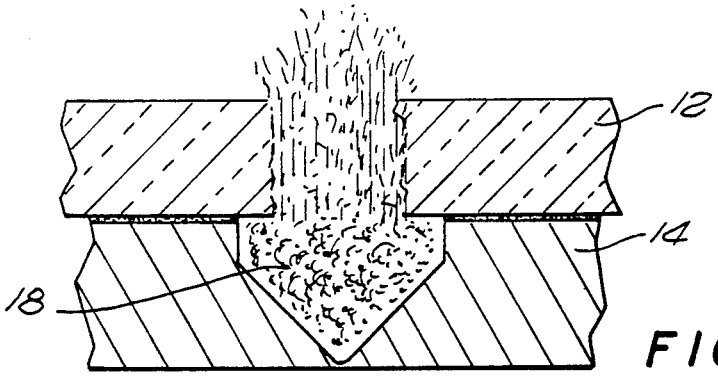
FIG. 3 is a side view of the explosive charge of FIG. 1, showing the penetration of the target by the explosive force of the detonated charge.
Figure 4:
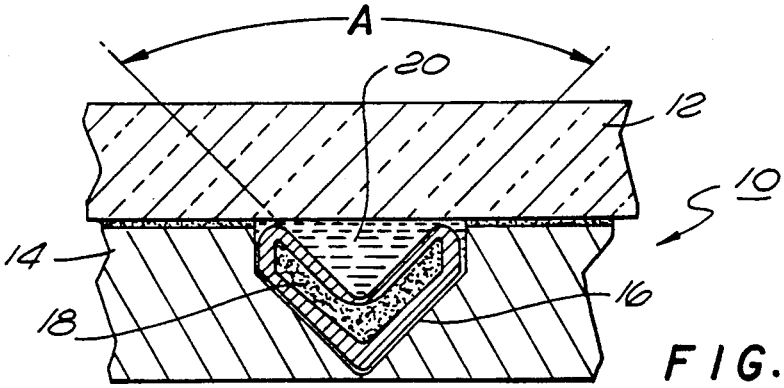
FIG. 4 is a side view of the explosive charge similar to FIG. 1, used with a water transmitting medium.

Interposed between the charge 18 and the target 12 is a transmitting medium 20 that transmits the shock waves from the detonated charge to the target 12. The transmitting medium 20 is constructed from an essentially incompressible material, so that the energy associated with the shock waves is not absorbed and dissipated by the medium. FIG. 2 shows the explosive charge 10 after the charge 18 has been detonated. The charge 18 produces high pressure shock waves 22 that are transmitted and directed toward the target 12 by the transmitting medium 20. The shock waves converge to produce an extremely high shear force that ruptures the target 12 as shown in FIG. 3. With the present invention the apex angle A between the V shaped portions of the charge 18, may be reduced from that of the prior art. The smaller apex angle A creates a smaller shear area and a smaller area of separation in the target. Experimental results have shown that to sever an polycarbonate canopy, an explosive device of the present invention required only 12 percent by weight the explosive charge needed for conventional explosive devices. Because of the efficient transfer of energy between the detonated charge and the target, it has been found that the dimensions and shape of the charge, and the space between the charge and target, are not as critical as the dimensions for explosive charges previously found in the art. The present invention thus provides an explosive charge 10 that is easier to produce and assemble from explosive charges known in the industry.

In the preferred embodiment, the transmitting medium 20 is a silicone rubber which is inserted into the groove 16 of the retainer 14. The rubber 20 can be applied in an unset form and then cured, so that the charge 18 is bonded to the retainer 14. The rubber adheres to both the target 12 and the retainer 14 so that there is no lines of separation between the target, rubber or retainer. This insures that the energy from the detonated explosive is fully transmitted to the target with little dissipation. The use of silicone rubber also provides a good environmental seal for the charge 18, so that the charge is not contaminated by moisture or the like. The rubber also protects the charge 18 from external shock and vibration loads. The rubber 18 should be formulated to be essentially incompressible, wherein all voids or other sources of air are eliminated from the material. Although rubber is described, it is to be understood that other incompressible materials can also be used. For instance hydraulic fluid, or water would be good candidates because of the incompressibility of those materials. Another suitable material would be epoxy, which can be easily applied to the retainer 14 and target 12. Even a solid material such as molded plastic could be used as the transmitting medium. The transmitting medium 20 should completely fill the space between the charge 18 and the target 12, so that there are no spaces that could dissipate the explosive energy of the charge 18.

While certain exemplary embodiments have been described in detail and shown in the accompanying drawings it is to be understood that such embodiments are merely illustrative of and not restrictive on the broad invention, and that this invention not be limited to the specific arrangements and constructions shown and described, since various other modifications may occur to those ordinarily skilled in the art.

What is claimed is:

1. An explosive device that can penetrate a target, comprising:

a target;

a retainer having a groove, said retainer being attached to said target such that said groove is adjacent to said target;

an explosive charge located in said groove adjacent to said retainer and spaced from said target; and, an essentially incompressible transmitting medium within said groove and interposed between said explosive charge and said target.

2. The device as recited in claim 1, wherein said explosive charge has a V shaped cross section.

3. The device as recited in claim 1, wherein said transmitting medium is water.

4. The device as recited in claim 1, wherein said transmitting medium is constructed from a rubber material.

5. The device as recited in claim 4, wherein said rubber includes silicone.

6. An explosive device that can penetrate a target, comprising:

a target;

a retainer having a groove, said retainer being attached to said target such that said groove is adjacent to said target;

an explosive charge located in said groove adjacent to said retainer and spaced from said target, said explosive charge having a V shaped cross section and being adapted to produce a pressurized wave upon detonation; and, an essentially incompressible rubber medium within said groove and interposed between said explosive charge and said target, said rubber medium being adapted to transmit said wave to said target so that said target is ruptured.

7. An explosive device that can sever an airplane canopy, comprising:

an airplane canopy;

a retainer having a groove, said retainer being attached to said canopy such that said groove is adjacent to said canopy;

an explosive charge located in said groove adjacent to said retainer and spaced from said canopy; and, an essentially incompressible transmitting medium within said groove and interposed between said explosive charge and said canopy.

8. The device as recited in claim 7, wherein said explosive charge has a V shaped cross section.

9. The device as recited in claim 7, wherein said transmitting medium is water.

10. The device as recited in claim 7, wherein said transmitting medium is constructed from a rubber material.

11. The device as recited in claim 10, wherein said rubber includes silicone.

12. An explosive device that can sever an airplane canopy, comprising:

an airplane canopy;

a retainer having a groove, said retainer being attached to said canopy such that said groove is adjacent to said canopy;

an explosive charge located in said groove adjacent to said retainer and spaced from said canopy, said explosive charge having a V shaped cross section and being adapted to produce a pressurized wave upon detonation; and, an essentially incompressible rubber medium within said groove and interposed between said explosive charge and said canopy, said rubber medium being adapted to transmit said wave to said canopy so that said canopy is ruptured.

* * * * *